United States Patent [19]

Hefele

[11] Patent Number: 4,504,517

[45] Date of Patent: Mar. 12, 1985

[54] PROCESS FOR THE REINFORCEMENT OF FLEXIBLE FLAT PARTS, SUCH AS TOP CLOTHS OR LININGS FOR ARTICLES OF CLOTHING

[75] Inventor: Josef Hefele, Gräfelfing, Fed. Rep. of Germany

[73] Assignee: Kufner Textilwerke GmbH, Munich, Fed. Rep. of Germany

[21] Appl. No.: 482,200

[22] Filed: Apr. 5, 1983

[30] Foreign Application Priority Data

May 13, 1982 [DE] Fed. Rep. of Germany ..... 3218050

[51] Int. Cl.[3] ..... B05D 1/14

[52] U.S. Cl. ..... 427/13; 264/24; 264/324; 427/206; 427/369; 427/370; 427/377; 427/389.9; 427/412; 428/90

[58] Field of Search ..... 156/72, 73.2, 307.1, 156/307.3, 307.5, 307.7, 245; 427/206, 13, 16, 369, 370, 377, 389.9, 412; 264/24, 324; 428/90

[56] References Cited

U.S. PATENT DOCUMENTS 2,695,244 11/1954 Fountain ..... 427/206
2,976,167 3/1961 Maeder et al. ..... 427/206
3,357,848 12/1967 Donahue et al. ..... 427/206
3,533,872 10/1970 Robbins et al. ..... 156/245
3,542,616 11/1970 Cain et al. ..... 156/245

FOREIGN PATENT DOCUMENTS 2145447 3/1972 Fed. Rep. of Germany .
3014656 10/1981 Fed. Rep. of Germany .

*Primary Examiner*—Marion E. McCamish
*Attorney, Agent, or Firm*—Scully, Scott, Murphy & Presser

[57] ABSTRACT

A process for the reinforcement of flexible flat parts, especially top cloths for articles of clothing or linings for such articles, in which process said flat parts are first printed on one side with an aqueous crosslinkable dispersion paste by the photogravure printing process and then are electrostatically flocked preferably with fibrous flocks, the flocks adhering to the paste, whereupon the paste is caused to undergo a condensation reaction after prestabilizing it by heat coagulation or by predrying, while said condensation reaction is performed with substantial exclusion of incoming air, under pressure and in the temperature range from 90° to 175° C. The process is simple, fast to complete, and leads to non-yellowed products.

10 Claims, 3 Drawing Figures

PROCESS FOR THE REINFORCEMENT OF FLEXIBLE FLAT PARTS, SUCH AS TOP CLOTHS OR LININGS FOR ARTICLES OF CLOTHING

The present invention concerns a process for the reinforcement of flexible flat parts, especially of top cloths for articles of clothing or linings for such articles.

In German Offenlegungsschrift No. 30 14 656, a process is described for the rear face reinforcement of top cloth cuts for articles of clothing and a device is also described according to which in a first working stage the top cloths are printed in screen form with flock bonding crosslinkable dispersion paste, whereupon said dispersion paste is first electrostatically coated with flocks, then prestabilised by heat coagulation and/or by predrying and lastly undergoes a condensation reaction in a further work stage in a heated chamber at 90° to 140° C., preferably at 100° to 130° C. The condensation reaction is preferably performed with the cuts stacked. Primarily fibres, e.g. ground cotton fibres, ground or cut rayon staple and synthetic fibres, especially polyamide fibres may be utilised as the flocks.

The practical implementation of the process has shown that the division of the heat treatment into a work stage in which prestabilisation is performed by heat coagulation and/or by predrying and a further work stage in which a condensation reaction is undertaken in the stack at high humidity is of importance to avoid on the one hand yellowing and on the other hand manifestations of dryness which latter would not only complicate further processing but can also lead to changes in the size of the cut parts. The elimination of any colour tone changes between the front parts of clothing provided with flocked layers and the normally untreated sleeves, side and back sections is of just as great importance for a correct article of clothing as the maintenance of the exact size during the flocking process and condensation reaction.

In order to be able to carry out the stack condensation reaction in the chamber, manual positioning of the top cloth cuts arriving from the first work stage and for turning over the stacked layers in the heated chamber is necessary. But in many cases it is desirable to dispense with such manual operations to be able to undertake the condensation reaction of the flocked parts.

According to one aspect of the invention, there is provided a process for the reinforcement of flexible flat parts, such as top cloths for articles of clothing, or linings for such articles, the process comprising: printing the flat parts on one side by a photogravure process with an aqueous cross-linkable dispersion paste; electrostatically flocking the flat parts, preferably with fibrous flocks, with the flocks adhering to said paste; prestabilising the paste by heat coagulation and/or by pre-drying; and then causing a condensation reaction to take place in said paste, which reaction is carried out (a) with substantial exclusion of incoming air, (b) under pressure (exerted on said flat parts), and (c) in the temperature range from 90° to 175° C.

According to another aspect of the invention, there is provided a device for carrying out the method.

For a better understanding of the invention and to show how the same may be carried into effect, reference will now be made, by way of example, to the accompanying drawings, in which.

Figure 1:
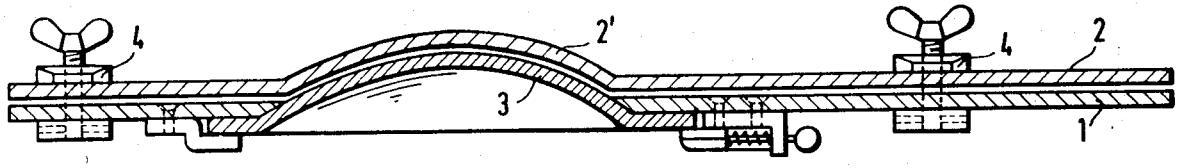
FIG. 1 shows a longitudinal section through an arcuate form for stacked condensation reaction.

In carrying out a process for the rear face reinforcement of top cloths cut for articles of clothing, it has now been found surprisingly that manifestations of yellowing, drying out and shrinkage can be avoided when the condensation reaction is performed with substantial exclusion of incoming air under pressure in the temperature range from 90° to 175° C., without having to accept other disadvantages. An especially favourable temperature range is between 100° and 165° C., with special preference for 110° to 155° C.

The condensation reaction can be performed between heated planar or arcuate covers laid under pressure on the flat parts with substantial to complete exclusion of air access. The covers can consist of e.g. metal, silicone rubber, glass fibre reinforced silicone rubber, teflon, glass fibre reinforced teflon or similar heat resistant materials.

The prestabilised flat parts arriving from the first work stage with relatively high humidity form a vapour cushion between the covers abutting them under pressure which prevents the access of air or at least greatly delays it and ensures a rapid heat exchange. Surprisingly the condensation reaction is not adversely affected by the steam atmosphere. At temperatures above 100° C. this steam is superheated.

According to a preferred embodiment of the invention, the condensation reaction is carried out in a reducing atmosphere. This can be achieved by the admixture of reducing components such as formic acid, but in a specially favourable manner by the discharge of decomposition or separation products of the dispersion paste being used. Thus dispersion pastes e.g. can be used in which the flockbinders emit traces of formaldehyde under these conditions.

The steam atmosphere slightly impregnated with formaldehyde inhibits oxidation effects of the atmospheric oxygen and therefore apparently the yellowing phenomena based on it, and additionally it is ensured by the pressure of the cover surfaces that the top cloth cuts remain dimensionally stable. Lastly the flat parts undergoing a condensation reaction in this way maintain a more or less high degree of residual humidity even after the condensation reaction. This is especially high when the subsequent cooling takes place between the covers, which causes no problems with condensation reaction in a stack, but is also possible with condensation reaction of individual (i.e. non-stacked) items.

As to the process steps of the process according to the invention, which are performed before the condensation reaction, reference is made expressly to German Offenlegungsschrift No. 30 14 656 and to German Offenlegungsschrift No. 30 21 039, the relevant doctrines of which are to be regarded as being introduced in full at this point.

The condensation reaction can e.g. be performed as follows: it can first be done basically in the same way as in German Offenlegungsschrift No. 30 14 656, but at a higher temperature, e.g. at 150° C. while a temperature effect period of from 10 to 20 minutes is used. The flat parts flocked at the back and stacked from 10 to 30 units high, e.g. cut front parts, of respectively a left and right front part with the flock layers facing each other, are e.g. covered on the top and bottom of the stack with respectively a planar aluminum plate stiffened with struts about 1 mm thick. The edges of the aluminum plate project beyond the edges of the cut parts. The spacing of the plates is reduced to about half of the loose top cloth layer by the use of pressure. By means of e.g. cover strips of foam or the like mounted laterally on the sides of the plate edges, and by clamping jaws, the top plate is linked with the bottom plate forming a closed stacked pile. A number of these stacked piles is then superimposed with an air gap left free between them and is heated in a correspondingly dimensioned return air furnace which is set at 150° C. for a period of about 15 minutes. Then the temperature is reduced to 120° C. and at this temperature the piles are kept in the return air furnace for up to a total of 60 minutes. After the end of this heating and condensation reaction period the stacked piles are removed, allowed to cool to a temperature below 80° C. and then the clamping jaws are released.

The top cloth parts now have a natural humidity and are smoothed. The flock side feels as soft as silk, and has an attractive appearance.

Instead of the planar plates, arcuate plates can also be used to obtain arcuate flat parts such as the front parts of articles of clothing which imitate the curve of the breast.

It is also possible, instead of utilising a stacked condensation reaction to carry out single part condensation reaction or e.g. condensation reaction for a left and right front part of an article of clothing, which are placed with the flocked sides facing each other.

In the case of single parts, special preference is given to a condensation reaction between heated cover strips which can be made of glass fibre reinforced teflon.

Within the framework of the process of the invention, special preference is given to control of the pressure in the range from 5 to 500 p/cm$^2$. Especially preferred pressure values are in the range from 10° to 150° C. p/cm$^2$.

To obtain the desired abutment pressure on the interposed flat parts, teflon belts can be slid in the area of the condensation reaction zone over slightly arcuate heating plates at the desired temperature, from e.g. 150° to 160° C. On the opposite side of the second teflon belt which contacts the teflon belt sliding away, infrared radiation heating can be provided. In principle, the belt installation corresponds to the usual continuous fixing press for affixing lining materials which are coated screenwise with textile adhesives. It is also possible to arrange for the condensation reaction installation with the transport belts to follow directly on the predrying and prestabilising furnace from the first work stage, but it is preferable to interpose a cleaning process for the removal of excess flock fibres on the prestabilised flat parts, while it is further possible before the arrival of the prestabilised flocked top cloth cuts in the condensation reaction installation to attach further fixing lining cuts, e.g. for the breast and shoulder reinforcement of a jacket front. The textile adhesive coating is melted in the condensation reaction installation and connected with the flock layer when, as is normal using continuous fixing presses, two press rollers are provided at the exit from the installation, which press the lining onto the top cloth cut. Behind the two press rollers, the two covering endless transport belts are separated and they now release the flat part having undergone condensation reaction, on which optionally a lining is affixed (glued). The endless transport belts then reverse above or below their joint guide through the condensation reaction zone via deflector rollers to return to the entry point for the flat parts, where they are again brought together by deflector rollers and slide away under abutment tension over the heater plates in order to provide the desired pressure on the flat parts carried between them.

The required length of the condensation reaction zone depends on the level of temperature chosen, the reactivity of the dispersion paste as a flockbinder and the speed at which the prestrengthened flat parts arrive from the flocking and prestabilising zone. At 155° C. in the condensation reaction zone normally a period lasting about 1 minute is enough, which would correspond at a supply speed from the prestabilising zone of 4 m/minute to about 4 m of length of the condensation reaction zone.

It is also possible to use instead of the two transport belts a large rotary heating drum which is synchronized with one of the two transport belts and is embraced by it. The flat part is then located between the wall of the heating drum and the transport belt and the condensed reaction is carried out during rotation of the heating drum. Due to the tension of the transport belt round the heating drum, the necessary pressure and the required protection against atmospheric oxygen influences are provided.

Figure 2:
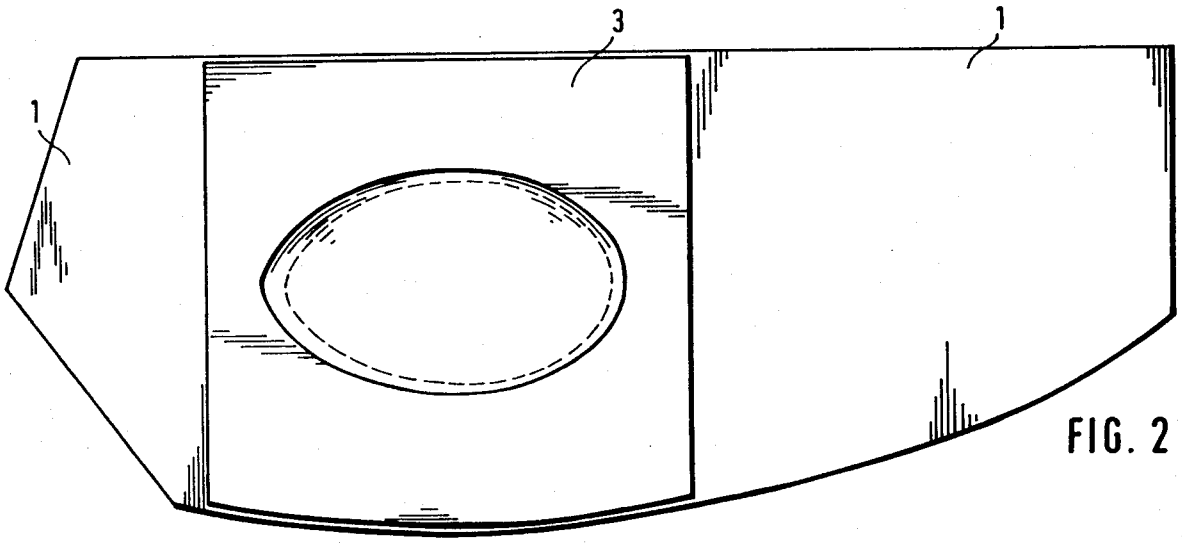
FIG. 2 shows a view from below of this arcuate form.

Coming now to the drawings in more detail, FIGS. 1 and 2 show a device having a planar bottom plate 1 with a recess for an arcuate form 3, which can have the approximate breast curved form for a male jacket in the case of a cloth cut. On the planar plate for example superimposed cuts are laid with the flock sides facing each other, optionally inserting a flat ancillary plate in the recess. Then the stack of about 20 superimposed cuts is covered by a second plate, the top plate 2, which has an arcuate form 2' on the recess of the bottom plate in the above mentioned breast curved form. Using strong pressure the top and bottom plates are clamped together by clamping screws 4 or other clamping elements, to form a stacked pile. The above arcuate form 3 is now pressed into the recess and connected with the lower plate. The flat parts clamped between the top and bottom plates are arched out by the inserted arcuate form 3. The arching is then fixed in the subsequent condensation reaction process so that later in the chemical cleaning phase there is no loss of the curvature. But the condensation reaction can also be completed between flat plates. Both with a condensation reaction between flat forms and arcuate forms it is expedient to place on the edges of the plates foam rubber strips, e.g. strips of silicone foam rubber, to achieve additional air exclusion.

A number of these stacked piles enclosed between the templates are laid on top of each other with an air gap left free between them and are inserted for the condensation reaction e.g. in a return air furnace which is first quickly heated to 160° C. Shortly after reaching this temperature in the recirculated air, the return air temperature is reduced to 120° C. within about 15 to 30 minutes, by mild ventilation. This temperature is now held until the end of the condensation reaction. After the end of the heating and condensation time, with a total of 70 minutes, the stacked pile is withdrawn, cooled to a temperature below 80° C., and the clamping elements are released. During the furnace treatment the top cloth parts in the stack's core attain a temperature of 120° C. and of 130° C. on the plate walls. They now have a natural humidity and are smoothed out. The flock side feels as soft as silk, and has an attractive appearance. Instead of the costly return air heating, high frequency heating can also be chosen, the advantage of which is that the heating phase is shortened.

Figure 3:
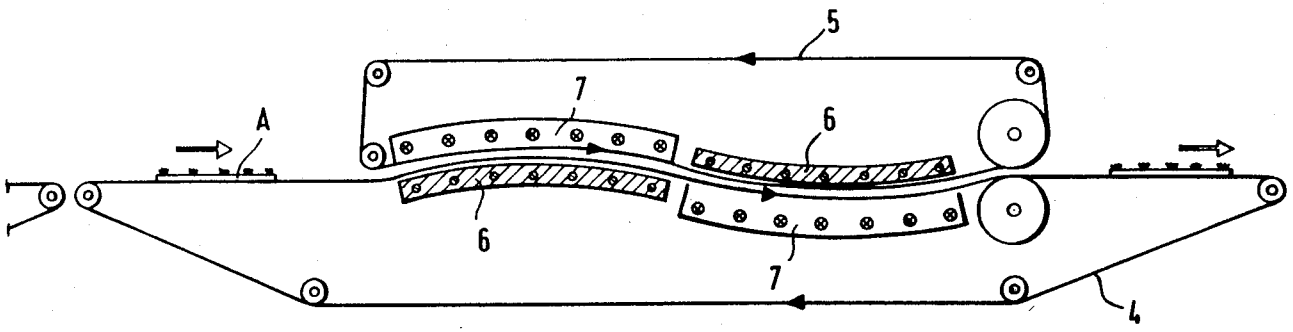
FIG. 3 shows a longitudinal section through an embodiment of condensation reaction device.

In FIG. 3 for example a condensation reaction installation is shown corresponding to the usual continuous fixing press. The product A coming from the cleaning zone is led via a teflon belt 4 with a counter-belt 5 over the heating plates 6, in the area of which respectively the infrared emitters 7 are disposed. After passing through this installation, the product is fully reacted to complete condensation and can be removed from the circulating belt 4.

I claim:

1. Process for the reinforcement of cut-out panels of fabrics, such as top cloths for articles of clothing, or linings for such articles, the process comprising: printing the flat parts on one side by a photogravure process with an aqueous cross-linkable dispersion paste; electrostatically flocking the flat parts, preferably with fibrous flocks, with the flocks adhering to said paste; pre-stabilising the paste by heat coagulation and/or by predrying; and then causing a condensation reaction to take place in said paste, which reaction is carried out (a) with exclusion of incoming air, (b) under pressure (exerted between planar or arcuate covers, between which the flat parts are enclosed) from 10 to 150 p/cm$^2$, and (c) in the temperature range from 90° to 175° C.

2. Process according to claim 1 wherein the condensation reaction is carried to completion.

3. Process according to claim 1 wherein the condensation reaction is performed in the temperature range from 110° to 155° C.

4. Process according to claim 1 wherein the condensation reaction is performed in a reducing atmosphere.

5. Process according to claim 4 wherein the reducing atmosphere is formed by discharge of decomposition or separation products of the dispersion paste used.

6. Process according to claim 1 wherein the condensation reaction is performed for from 1 to 60 minutes.

7. Process according to claim 1 wherein the condensation reaction is effected in a heated chamber, e.g. in a continuous fixing press.

8. Process according to claim 1 wherein for the condensation reaction, the flat parts are guided between air and humidity impermeable belts, between which they are enclosed with abutment pressure, while said belts are led under tension past heater means.

9. Process according to claim 1 wherein the flat parts are led round a rotary drum and are pressed onto the drum surface by means of a belt which is at least partly wrapped tensely round said drum.

10. Process according to claim 1 wherein the condensation reaction of the prestabilised flocked top cloth cuts is carried out with fixing lining cuts laid upon them, which have a screen type textile adhesive layer, and thereafter pressing is carried out.

* * * * *